US011250760B2

(12) United States Patent
Park et al.

(10) Patent No.: US 11,250,760 B2
(45) Date of Patent: Feb. 15, 2022

(54) DISPLAY APPARATUS, DISPLAY SYSTEM HAVING THE SAME AND METHOD OF COMPENSATING DISPLAY QUALITY USING THE SAME

(71) Applicant: Samsung Display Co., Ltd., Yongin-Si (KR)

(72) Inventors: Seung Hwan Park, Anyang-si (KR); Kang Hyun Kim, Seoul (KR); Hoi Sik Moon, Hwaseong-si (KR); Jae-Seob Chung, Asan-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/146,717

(22) Filed: Jan. 12, 2021

(65) Prior Publication Data

US 2021/0264838 A1 Aug. 26, 2021

(30) Foreign Application Priority Data

Feb. 21, 2020 (KR) ..... 10-2020-0021829

(51) Int. Cl.
*G09G 3/20* (2006.01)

(52) U.S. Cl.
CPC ... *G09G 3/2003* (2013.01); *G09G 2310/0267* (2013.01); *G09G 2310/0275* (2013.01); *G09G 2320/0242* (2013.01); *G09G 2320/0285* (2013.01); *G09G 2320/0666* (2013.01); *G09G 2320/0673* (2013.01)

(58) Field of Classification Search
CPC ..... G09G 3/2003; G09G 2310/0267; G09G 2310/0275; G09G 2320/0242; G09G 2320/0285; G09G 2320/0666; G09G 2320/0673
See application file for complete search history.

(56) References Cited

U.S. PATENT DOCUMENTS

2016/0379594 A1* 12/2016 Cho ..... G09G 5/04 345/601
2017/0116901 A1* 4/2017 Ogoshi ..... H04N 17/04
2017/0213493 A1* 7/2017 Han ..... G09G 3/3208
2018/0018938 A1* 1/2018 Lee ..... G09G 3/20
(Continued)

FOREIGN PATENT DOCUMENTS

KR 10-2008-0049264 A 6/2008
KR 10-2014-0144612 A 12/2014
KR 10-2016-0011300 A 2/2016

*Primary Examiner* — Premal R Patel
(74) *Attorney, Agent, or Firm* — Innovation Counsel LLP

(57) ABSTRACT

A display apparatus includes a display panel, a gate driver, a data driver and a driving controller. The display panel is configured to display an image based on input image data. The gate driver is configured to output gate signals to gate lines of the display panel. The data driver is configured to output data voltages to data lines of the display panel. The driving controller includes a first compensation lookup table and a second compensation lookup table which are configured to compensate the input image data. The driving controller is configured to select one of the first compensation lookup table and the second compensation lookup table based on a first color shift and a second color shift and to apply the selected one of the first compensation lookup table and the second compensation lookup table to the input image data.

20 Claims, 11 Drawing Sheets

(56) References Cited

U.S. PATENT DOCUMENTS

| | | | | |
|---|---|---|---|---|
| 2018/0151103 | A1* | 5/2018 | Koudo | G09G 3/36 |
| 2019/0221173 | A1* | 7/2019 | Lee | G02F 1/1323 |
| 2021/0193011 | A1* | 6/2021 | Chang | G09G 3/3225 |

* cited by examiner

DISPLAY APPARATUS, DISPLAY SYSTEM HAVING THE SAME AND METHOD OF COMPENSATING DISPLAY QUALITY USING THE SAME

PRIORITY STATEMENT

This application claims priority under 35 U.S.C. § 119 to Korean Patent Application No. 10-2020-0021829, filed on Feb. 21, 2020 in the Korean Intellectual Property Office KIPO, the contents of which are herein incorporated by reference in their entireties.

BACKGROUND

1. Field

Example embodiments of the present inventive concept relate to a display apparatus, a display system including the display apparatus and a method of compensating a display quality of the display apparatus using the display apparatus. More particularly, example embodiments of the present inventive concept relate to a display apparatus compensating a spread of a color shift which means a difference between a color sense of a front view and a color sense of a side view, a display system including the display apparatus and a method of compensating a display quality of the display apparatus using the display apparatus.

2. Description of the Related Art

Generally, a display apparatus includes a display panel and a display panel driver. The display panel includes a plurality of gate lines, a plurality of data lines and a plurality of pixels. The display panel driver includes a gate driver and a data driver. The gate driver outputs gate signals to the gate lines. The data driver outputs data voltages to the data lines.

A display product for providing public information may include a plurality of display panels disposed in a matrix form. Color coordinates of the display panels may be unified with respect to front views to compensate a difference of color senses between the display panels.

In this case, the color senses of the display panels in side views may be varied due to a spread of a color shift of the display panels which means a difference between a color sense of a front view and a color sense of a side view of the display panel.

SUMMARY

Example embodiments of the present inventive concept provide a display apparatus compensating a spread of a color shift.

Example embodiments of the present inventive concept also provide a display system including the above-mentioned display apparatus.

Example embodiments of the present inventive concept also provide a method of compensating a display quality of the display panel using the above-mentioned display apparatus.

In an example embodiment of a display apparatus according to the present inventive concept, the display apparatus includes a display panel, a gate driver, a data driver and a driving controller. The display panel is configured to display an image based on input image data. The gate driver is configured to output gate signals to gate lines of the display panel. The data driver is configured to output data voltages to data lines of the display panel. The driving controller includes a first compensation lookup table and a second compensation lookup table which are configured to compensate the input image data. The driving controller is configured to select one of the first compensation lookup table and the second compensation lookup table based on a first color shift and a second color shift and to apply the selected one of the first compensation lookup table and the second compensation lookup table to the input image data. The first color shift means a difference between a front color coordinate and a side color coordinate of the input image data to which the first compensation lookup table is applied. The second color shift means a difference between a front color coordinate and a side color coordinate of the input image data to which the second compensation lookup table is applied.

In an example embodiment, the first compensation lookup table may include a first high lookup table corresponding to a first high gamma curve and a first low lookup table corresponding to a first low gamma curve. The second compensation lookup table may include a second high lookup table corresponding to a second high gamma curve and a second low lookup table corresponding to a second low gamma curve.

In an example embodiment, the first high gamma curve may coincide with the second high gamma curve and the first low gamma curve coincides with the second low gamma curve in a grayscale range lower than a reference grayscale value. The first high gamma curve may be different from the second high gamma curve and the first low gamma curve is different from the second low gamma curve in a grayscale range equal to or greater than the reference grayscale value.

In an example embodiment, a difference between the first high gamma curve and the first low gamma curve may be greater than a difference between the second high gamma curve and the second low gamma curve.

In an example embodiment, a front color coordinate of a first image to which the first compensation lookup table may be applied coincides with a front color coordinate of a second image to which the second compensation lookup table.

In an example embodiment, a side color coordinate of the first image may be different from a side color coordinate of the second image.

In an example embodiment, a difference between the front color coordinate and the side color coordinate of the first image may be less than a difference between the front color coordinate and the side color coordinate of the second image.

In an example embodiment, the driving controller may further include a third compensation lookup table, the driving controller configured to select one of the first compensation lookup table, the second compensation lookup table and the third compensation lookup table and to apply the selected one of the first compensation lookup table, the second compensation lookup table and the third compensation lookup table to the input image data. The first compensation lookup table may include a first high lookup table corresponding to a first high gamma curve and a first low lookup table corresponding to a first low gamma curve. The second compensation lookup table may include a second high lookup table corresponding to a second high gamma curve and a second low lookup table corresponding to a second low gamma curve. The third compensation lookup table may include a third high lookup table corresponding to a third high gamma curve and a third low lookup table corresponding to a third low gamma curve.

In an example embodiment, the first high gamma curve, the second high gamma curve and the third high gamma curve may coincide with one another and the first low gamma curve, the second low gamma curve and the third low gamma curve may coincide with one another in a grayscale range lower than a reference grayscale value. The first high gamma curve, the second high gamma curve and the third high gamma curve may be different from one another and the first low gamma curve, the second low gamma curve and the third low gamma curve may be different from one another in a grayscale range equal to or greater than the reference grayscale value.

In an example embodiment, the display panel may include a plurality of pixels. The pixel may include a first switching element connected to a first gate line and a first data line, a first capacitor connected to the first switching element, a second switching element connected to the first gate line and a second data line and a second capacitor connected to the second switching element.

In an example embodiment of a display system according to the present inventive concept, the display system includes a first display apparatus and a second display apparatus. The first display apparatus includes a first compensation lookup table and a second compensation lookup table and is configured to select one of the first compensation lookup table and the second compensation lookup table based on a first color shift, which means a difference between a front color coordinate and a side color coordinate of first input image data to which the first compensation lookup table is applied, and a second color shift, which means a difference between a front color coordinate and a side color coordinate of the first input image data to which the second compensation lookup table is applied, and to apply the selected one of the first compensation lookup table and the second compensation lookup table to the first input image data. The second display apparatus includes a third compensation lookup table and a fourth compensation lookup table and configured to select one of the third compensation lookup table and the fourth compensation lookup table based on a third color shift, which means a difference between a front color coordinate and a side color coordinate of second input image data to which the third compensation lookup table is applied, and a fourth color shift, which means a difference between a front color coordinate and a side color coordinate of the second input image data to which the fourth compensation lookup table is applied, and to apply the selected one of the third compensation lookup table and the fourth compensation lookup table to the input image data.

In an example embodiment, the first display apparatus may be configured to select one of the first compensation lookup table and the second compensation lookup table such that a difference of a color shift of the first display apparatus and a color shift of the second display apparatus is minimized. The second display apparatus may be configured to select one of the third compensation lookup table and the fourth compensation lookup table such that the difference of the color shift of the first display apparatus and the color shift of the second display apparatus is minimized.

In an example embodiment of a compensating a display quality of a display apparatus according to the present inventive concept, the method includes measuring a front display image and a side display image of each of display panels of display apparatuses, predicting tristimulus values of the front display image and the side display image of the each of the display panels for entire grayscale values, compensating color coordinates of input image data of the each of the display panels, determining first color shifts of the each of the display panels using the predicted tristimulus values for the entire grayscale values, the compensated color coordinate and a first compensation lookup table of the each of the display panels, determining second color shifts of the each of the display panels using the predicted tristimulus values for the entire grayscale values, the compensated color coordinate and a second compensation lookup table of the each of the display panels and selecting one of the first compensation lookup table and the second compensation lookup table in the each of the display panels using the first color shifts of the each of the display panels and the second color shifts of the each of the display panels.

In an example embodiment, the predicting the tristimulus values for the entire grayscale values may include calculating a luminance of a first color, a luminance of a second color and a luminance of a third color in a first grayscale value using a formula below:

$$\begin{bmatrix} \frac{R_x}{R_y} & \frac{G_x}{G_y} & \frac{B_x}{B_y} \\ 1 & 1 & 1 \\ \frac{R_z}{R_y} & \frac{G_z}{G_y} & \frac{B_z}{B_y} \end{bmatrix}^{-1} \begin{bmatrix} X_{gray} \\ Y_{gray} \\ Z_{gray} \end{bmatrix} = \begin{bmatrix} Y_R \\ Y_G \\ Y_B \end{bmatrix}$$

where, in the first grayscale value, Rx is x color coordinate of the first color, Ry is y color coordinate of the first color and Rz=1−Rx−Ry, Gx is x color coordinate of the second color, Gy is y color coordinate of the second color, and Gz=1−Gx−Gy, Bx is x color coordinate of the third color and By is y color coordinate of the third color and Bz=1−Bx−By, the measured tristimulus values of an achromatic color in the first grayscale value are Xgray, Ygray and Zgray, and a luminance of the first color is YR, a luminance of the second color is YG and a luminance of the third color is YB.

In an example embodiment, the compensating the color coordinates of the input image data may include clipping a grayscale value outside a target color coordinate.

In an example embodiment, the first compensation lookup table may include a first high lookup table corresponding to a first high gamma curve and a first low lookup table corresponding to a first low gamma curve. The second compensation lookup table may include a second high lookup table corresponding to a second high gamma curve and a second low lookup table corresponding to a second low gamma curve.

In an example embodiment, the first high gamma curve may coincide with the second high gamma curve and the first low gamma curve coincides with the second low gamma curve in a grayscale range lower than a reference grayscale value. The first high gamma curve may be different from the second high gamma curve and the first low gamma curve is different from the second low gamma curve in a grayscale range equal to or greater than the reference grayscale value.

In an example embodiment, the method may further include determining third color shifts of the each of the display panels using the predicted tristimulus values for the entire grayscale values, the compensated color coordinate and a third compensation lookup table of the each of the display panels. The first compensation lookup table may include a first high lookup table corresponding to a first high gamma curve and a first low lookup table corresponding to a first low gamma curve. The second compensation lookup table may include a second high lookup table corresponding to a second high gamma curve and a second low lookup table corresponding to a second low gamma curve. The third compensation lookup table may include a third high lookup table corresponding to a third high gamma curve and a third low lookup table corresponding to a third low gamma curve.

In an example embodiment, the each of the display panels may be configured to select one of the first compensation lookup table and the second compensation lookup table such that a difference of a color shift between the display panels become minimized.

In an example embodiment, the selecting one of the first compensation lookup table and the second compensation lookup table in the each of the display panels using the first color shifts of the each of the display panels and the second color shifts of the each of the display panels uses a plurality of target color shift.

According to the display apparatus, the display system including the display apparatus and the method of compensating the display quality of the display apparatus using the display apparatus, each display apparatus may select an optimal value between a first color shift generated using a first lookup table and a second color shift generated using a second lookup table so that the difference of the color shifts of the plural display apparatuses may be compensated.

Thus, the display quality of the display system including the plural display apparatuses may be enhanced.

BRIEF DESCRIPTION OF THE DRAWINGS

The above and other features and advantages of the present inventive concept will become more apparent by describing in detailed example embodiments thereof with reference to the accompanying drawings, in which.

DETAILED DESCRIPTION OF THE INVENTIVE CONCEPT

Hereinafter, the present inventive concept will be explained in detail with reference to the accompanying drawings.

Figure 1:
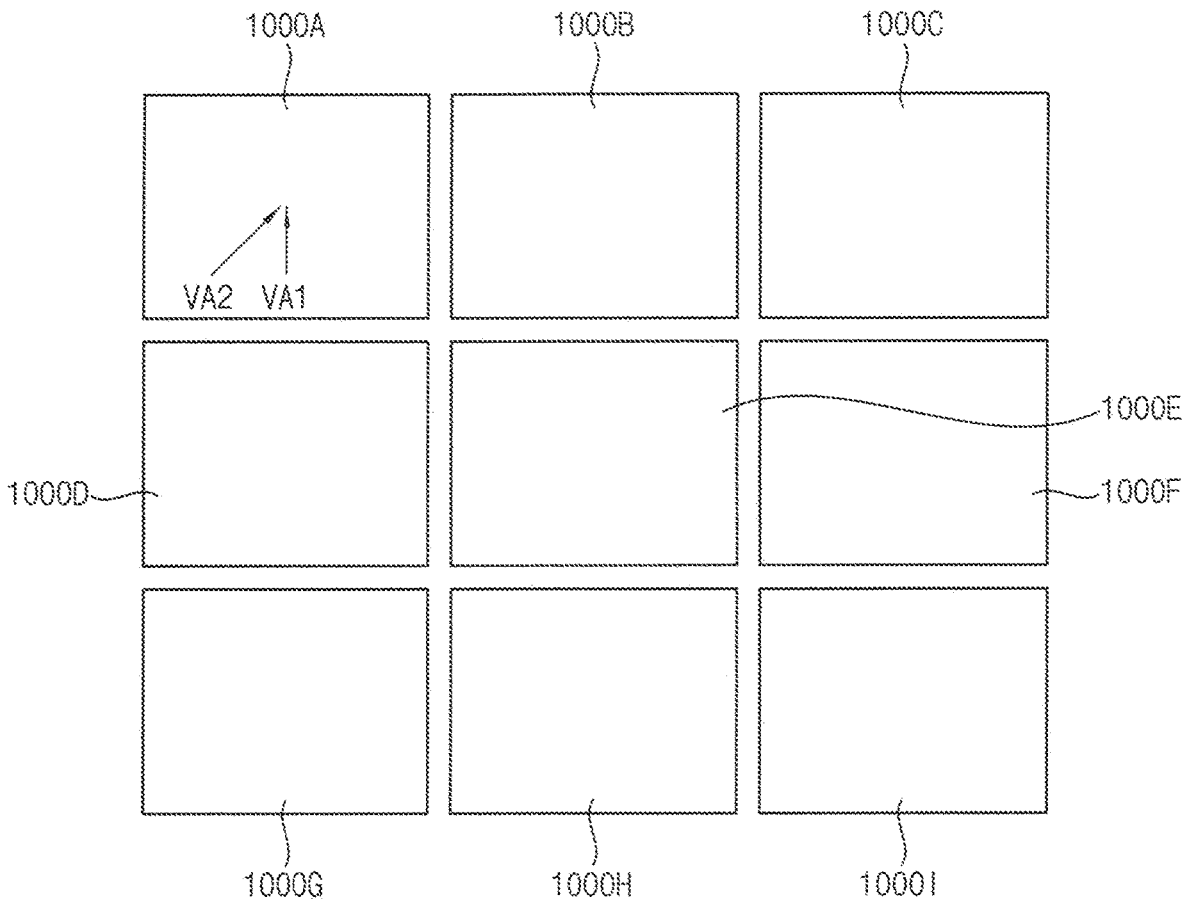
FIG. 1 is a block diagram illustrating a display system according to an example embodiment of the present inventive concept.

FIG. 1 is a block diagram illustrating a display system according to an example embodiment of the present inventive concept.

Referring to FIG. 1, the display system may include a plurality of display apparatuses 1000A, 1000B, 1000C, 1000D, 1000E, 1000F, 1000G, 1000H and 1000I. The display apparatuses may be disposed adjacent to each other. The display apparatuses may be disposed in a matrix form.

For example, the display system may be an information display system installed at a public place.

A color coordinate of a display image in a front view VA1 of the display apparatus 1000A may be referred to as a front color coordinate. A color coordinate of the display image in a side view VA2 (e.g. in 45 degrees) of the display apparatus 1000A may be referred to as a side color coordinate. The difference between the front color coordinate and the side color coordinate may be referred to as a color shift.

When the front color coordinates of the display apparatuses are compensated to coincide with each other, front color senses of the display apparatuses may be substantially identical.

However, a spread of a color shift may occur due to a process spread of the display apparatuses. Accordingly, even if the front color coordinates of the display apparatuses coincide with each other, the difference of the color senses in the side views may be perceive to a user when the spread of the color shift occurs.

Figure 2:
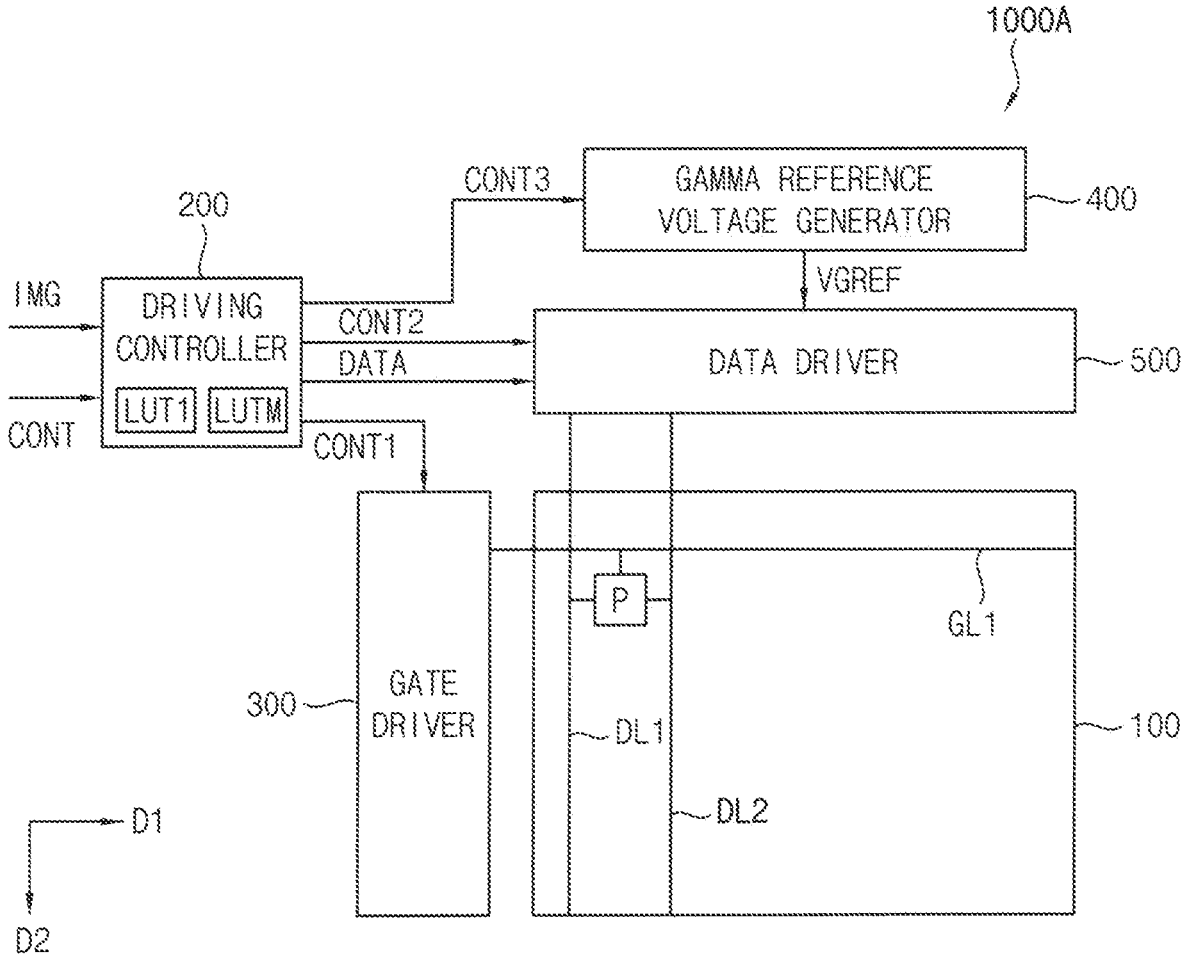
FIG. 2 is a block diagram illustrating a display apparatus of FIG. 1.

FIG. 2 is a block diagram illustrating a display apparatus 1000A of FIG. 1.

Referring to FIGS. 1 and 2, the display apparatus 1000A includes a display panel 100 and a display panel driver. The display panel driver includes a driving controller 200, a gate driver 300, a gamma reference voltage generator 400 and a data driver 500.

Although a first display apparatus 1000A is explained in FIG. 2, each of the display devices 1000A, 1000B, 1000C, 1000D, 1000E, 1000F, 1000G, 1000H and 1000I of FIG. 1 may have the same structure as FIG. 2.

The display panel 100 includes a display region and a peripheral region adjacent to the display region.

The display panel 100 includes a plurality of gate lines GL (GL1), a plurality of data lines DL (DL1, DL2) and a plurality of pixels P electrically connected to the gate lines GL and the data lines DL. The gate lines GL extend in a first direction D1 and the data lines DL extend in a second direction D2 crossing the first direction D1.

The driving controller 200 receives input image data IMG and an input control signal CONT from an external apparatus, for example, a graphic controller (not shown). The input image data IMG may include red image data, green image data and blue image data. The input image data IMG may include white image data. The input image data IMG may include magenta image data, yellow image data and cyan image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3 and a data signal DATA using the input image data IMG and the input control signal CONT.

The driving controller 200 generates the first control signal CONT1 for controlling an operation of the gate driver 300 using the input control signal CONT, and outputs the first control signal CONT1 to the gate driver 300. The first control signal CONT1 may include a vertical start signal and a gate clock signal.

The driving controller 200 generates the second control signal CONT2 for controlling an operation of the data driver 500 using the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 using the input control signal CONT, and outputs the third control signal CONT3 to the gamma reference voltage generator 400.

The gate driver 300 generates gate signals driving the gate lines GL in response to the first control signal CONT1 received from the driving controller 200. For example, the gate driver 300 may sequentially output the gate signals to the gate lines GL. For example, the gate driver 300 may be integrated on the display panel 100. For example, the gate driver 300 may be mounted on the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an example embodiment, the gamma reference voltage generator 400 may be disposed in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

Figure 3:
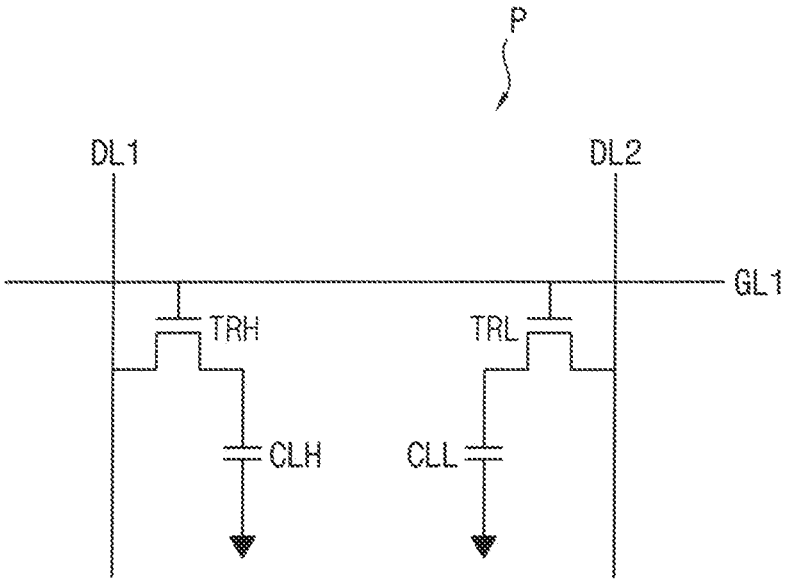
FIG. 3 is a circuit diagram illustrating a pixel of FIG. 2.

FIG. 3 is a circuit diagram illustrating the pixel P of FIG. 2.

Referring to FIGS. 1 to 3, the pixel P of the display panel 100 may include a high subpixel and a low subpixel to enhance a side visibility.

The pixel P may include a first switching element TRH connected to a first gate line GL1 and a first data line DL1, a first liquid crystal capacitor CLH connected to the first switching element TRH, a second switching element TRL connected to the first gate line GL1 and a second date line DL2, and a second liquid crystal capacitor CLL connected to the second switching element TRL.

The first switching element TRH and the first liquid crystal capacitor CLH of the pixel P may form the high subpixel. The second switching element TRL and the second liquid crystal capacitor CLL of the pixel P may form the low subpixel.

Figure 4:
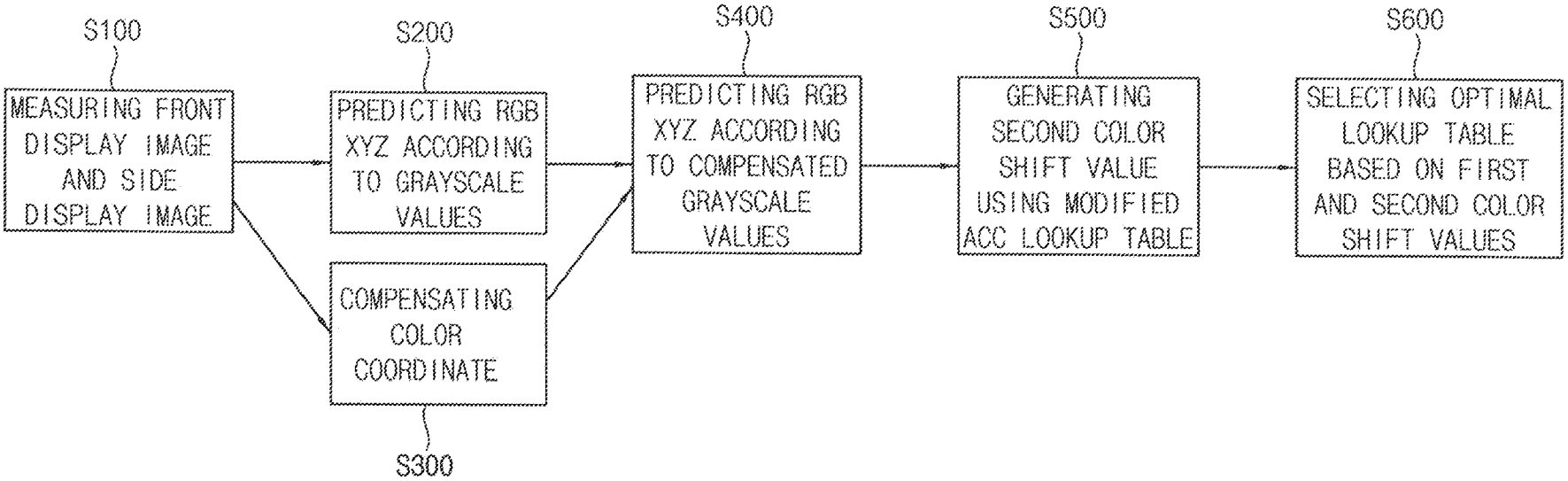
FIG. 4 is a flowchart diagram illustrating a method of compensating a display quality of the display apparatus of FIG. 1.
Figure 5:
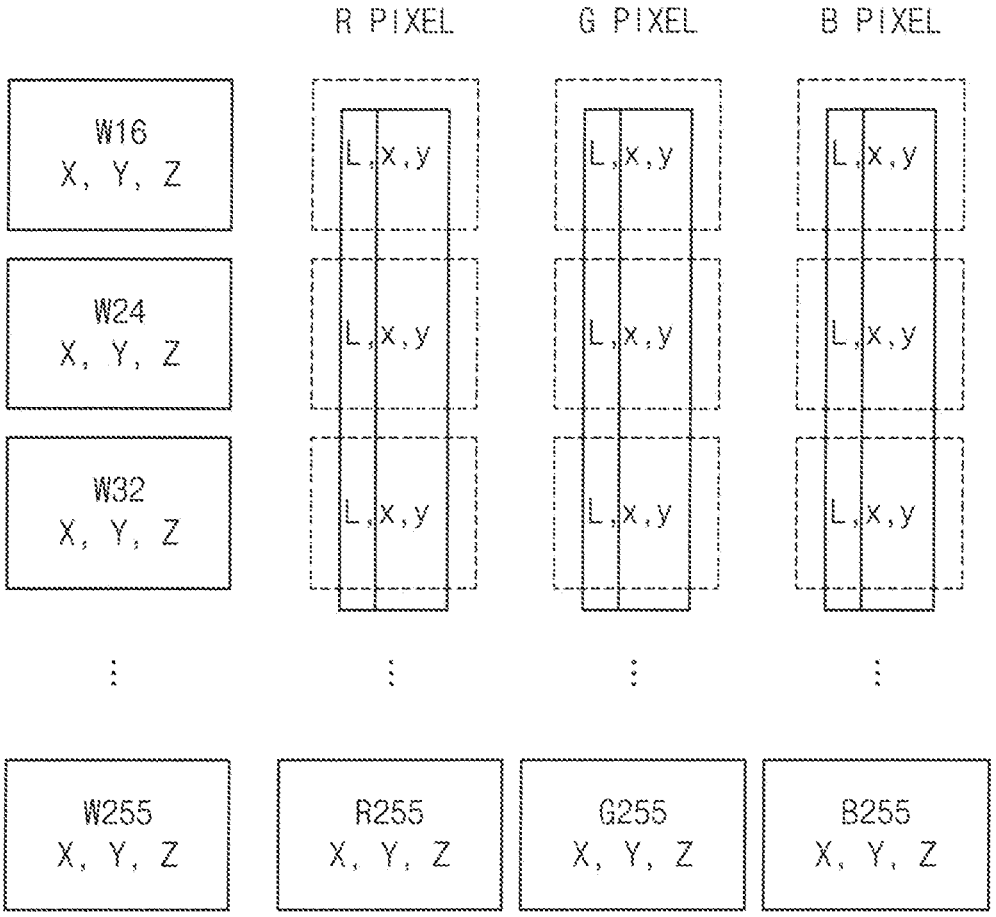
FIG. 5 is a conceptual diagram illustrating a step of S200 of FIG. 4.
Figure 6:
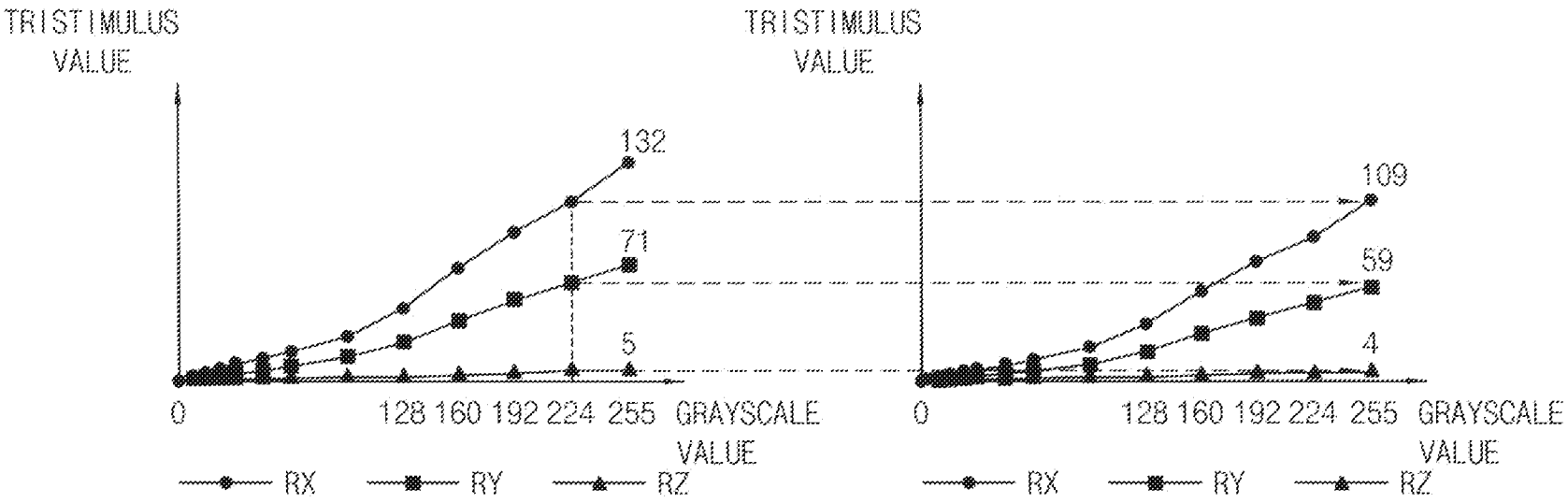
FIG. 6 is a graph illustrating a step of S300 of FIG. 4.

FIG. 4 is a flowchart diagram illustrating a method of compensating a display quality of the display apparatus of FIG. 1. FIG. 5 is a conceptual diagram illustrating a step of S200 of FIG. 4. FIG. 6 is a graph illustrating a step of S300 of FIG. 4.

Referring to FIGS. 1 to 6, front display images and side display images of the display apparatuses may be measured (step S100) to compensate the spread of the color shift of the display apparatuses.

For convenience of explanation a single data set is illustrated in FIG. 5. If the single data set illustrated in FIG. 5 is a data set of the front display image, the side display image may also have a separate data set like FIG. 5.

When the front display image is measured by a measuring apparatus, a plurality of WHITE grayscale images (e.g., W16, W24, W32, . . . , W255), a full grayscale image of a first color (e.g., R255: 255 grayscale of red color), a full grayscale image of a second color (e.g., G255; 255 grayscale of green color) and a full grayscale image of a third color (e.g., B255; 255 grayscale of blue color) may be measured. Herein, tristimulus values X, Y and Z for the plurality of WHITE grayscale images (e.g., W16, W24, W32, . . . , W255), the full grayscale image of a first color (e.g., R255), a full grayscale image of a second color (e.g., G255) and a full grayscale image of a third color (e.g., B255) may be respectively obtained. In addition, the tristimulus values X, Y and Z may be converted to L, x and y values by following Equations 1, 2 and 3.

$$L=Y \quad \text{[Equation 1]}$$

$$x=X/(X+Y+Z) \quad \text{[Equation 2]}$$

$$y=Y/(X+Y+Z) \quad \text{[Equation 3]}$$

In addition, the tristimulus values for entire grayscale values of the front display image and the side display image of the display panels may be predicted based on the measured results for the above-mentioned sample images (e.g., W16, W24, W32, . . . , W255, R255, G255 and B255). (step S200)

In the step of predicting the tristimulus values for the entire grayscale values, firstly, x and y values of each grayscale values may be predicted based on R255, G255 and B255. For example, the x and y values (Rx and Ry) of 16 grayscale image of the first color (R16), the x and y values (Rx and Ry) of 24 grayscale image of the first color (R24), the x and y values (Rx and Ry) of 32 grayscale image of the first color (R32) and so on may be obtained based on the full grayscale image of the first color (R255). For example, the x and y values (Gx and Gy) of 16 grayscale image of the second color (G16), the x and y values (Gx and Gy) of 24 grayscale image of the second color (G24), the x and y values (Gx and Gy) of 32 grayscale image of the second color (G32) and so on may be obtained based on the full grayscale image of the second color (G255). For example, the x and y values (Bx and By) of 16 grayscale image of the third color (B16), the x and y values (Bx and By) of 24 grayscale image of the third color (B24), the x and y values (Bx and By) of 32 grayscale image of the third color (B32) and so on may be obtained based on the full grayscale image of the third color (B255).

In addition, in the step of predicting the tristimulus values for the entire grayscale values, L value (=Y value) of each grayscale values may be predicted based on R255, G255 and B255. For example, in the step of predicting the tristimulus values for the entire grayscale values, a luminance of the first color $Y_R$, a luminance of the second color $Y_G$ and a luminance of the third color $Y_B$ of each grayscale value may be calculated using following Equation 4.

$$\begin{bmatrix} \frac{R_x}{R_y} & \frac{G_x}{G_y} & \frac{B_x}{B_y} \\ 1 & 1 & 1 \\ \frac{R_z}{R_y} & \frac{G_z}{G_y} & \frac{B_z}{B_y} \end{bmatrix}^{-1} \begin{bmatrix} X_{gray} \\ Y_{gray} \\ Z_{gray} \end{bmatrix} = \begin{bmatrix} Y_R \\ Y_G \\ Y_B \end{bmatrix} \quad \text{[Equation 4]}$$

Herein, in a first grayscale value, x color coordinate of the first color is Rx and y color coordinate of the first color is Ry and Rz=1−Rx−Ry. In the first grayscale value, x color coordinate of the second color is Gx and y color coordinate of the second color is Gy and Gz=1−Gx−Gy. In the first grayscale value, x color coordinate of the third color is Bx and y color coordinate of the third color is By and Bz=1−Bx−By. The measured tristimulus values of the achromatic color in the first grayscale value are Xgray, Ygray and Zgray. In the first grayscale value, a luminance of the first color is $Y_R$, a luminance of the second color is $Y_G$ and a luminance of the third color is $Y_B$. Herein, the first grayscale value may mean a random grayscale value.

In this method, L, x and y may be obtained for the entire grayscale values. Using the above Equations 1, 2 and 3, L, x and y for the entire grayscale values may be converted into X, Y and Z.

In addition, the display apparatuses may compensate the color coordinates of the input image data IMG of the display panels (step S300). The input image data having the compensated color coordinate may be referred to as IMG2.

The step (S300) of compensating the color coordinate may include clipping grayscale values outside a target color coordinate.

In FIG. 6, a maximum grayscale value of the first color may be decreased from 255 grayscale to 224 grayscale to match a desired target color coordinate. When the tristimulus values RX, RY and RZ of the first color in 255 grayscale are respectively 132, 71 and 5 and the tristimulus values RX, RY and RZ of the first color in 224 grayscale are respectively 109, 59 and 4, the tristimulus values RX, RY and RZ of the first color may be converted by an interpolation method such that the tristimulus values RX, RY and RZ of the first color in 255 grayscale become respectively 109, 59 and 4 after the clipping step.

Although the clipping method of the first color is explained in FIG. 6, the clipping method in FIG. 6 may be applied to the second color and the third color in the step (S300) of compensating the color coordinate as needed.

Figure 7:
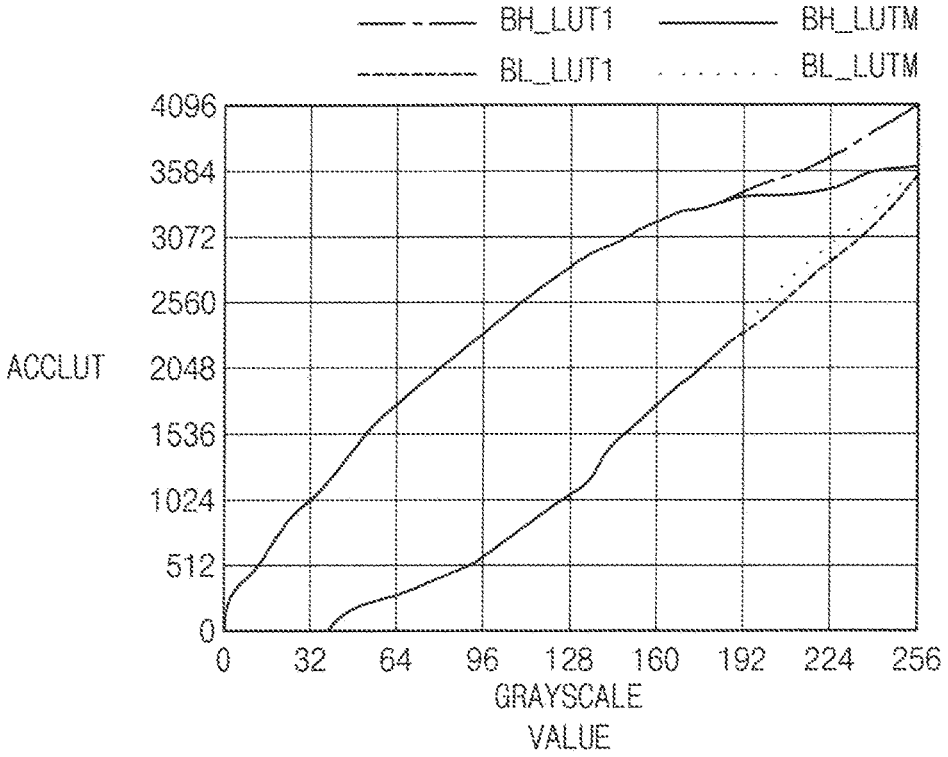
FIG. 7 is a graph illustrating a first compensation lookup table and a second compensation lookup table of the display apparatus of FIG. 1.
Figure 8:
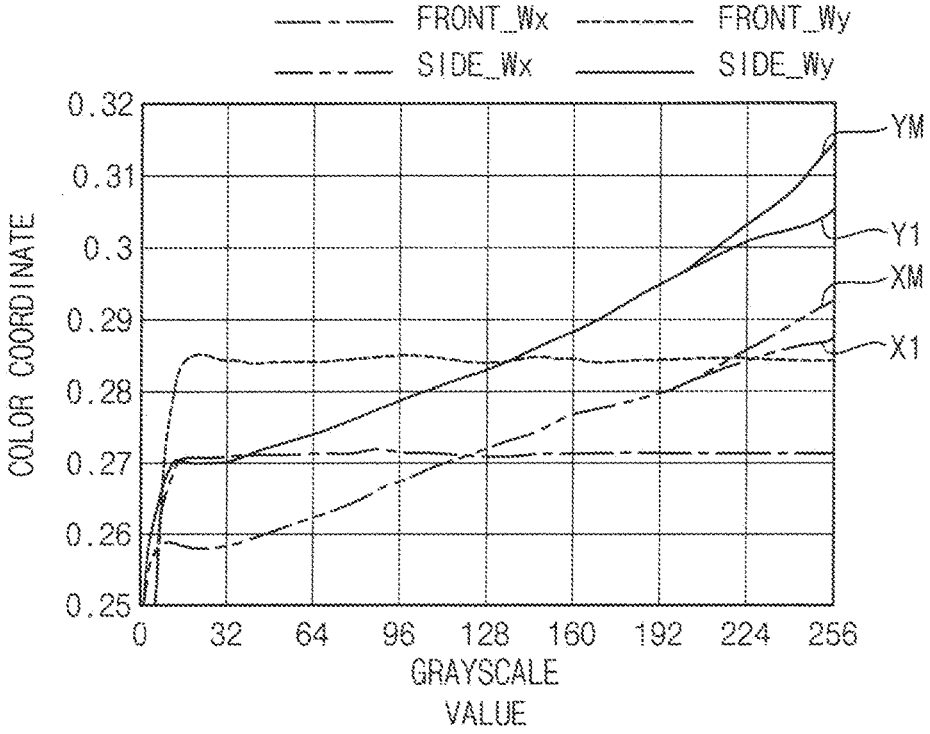
FIG. 8 is a graph illustrating a front color coordinate and a side color coordinate of a first image to which the first compensation lookup table of FIG. 7 is applied and a front color coordinate and a side color coordinate of a second image to which the second compensation lookup table of FIG. 7.
Figure 9:
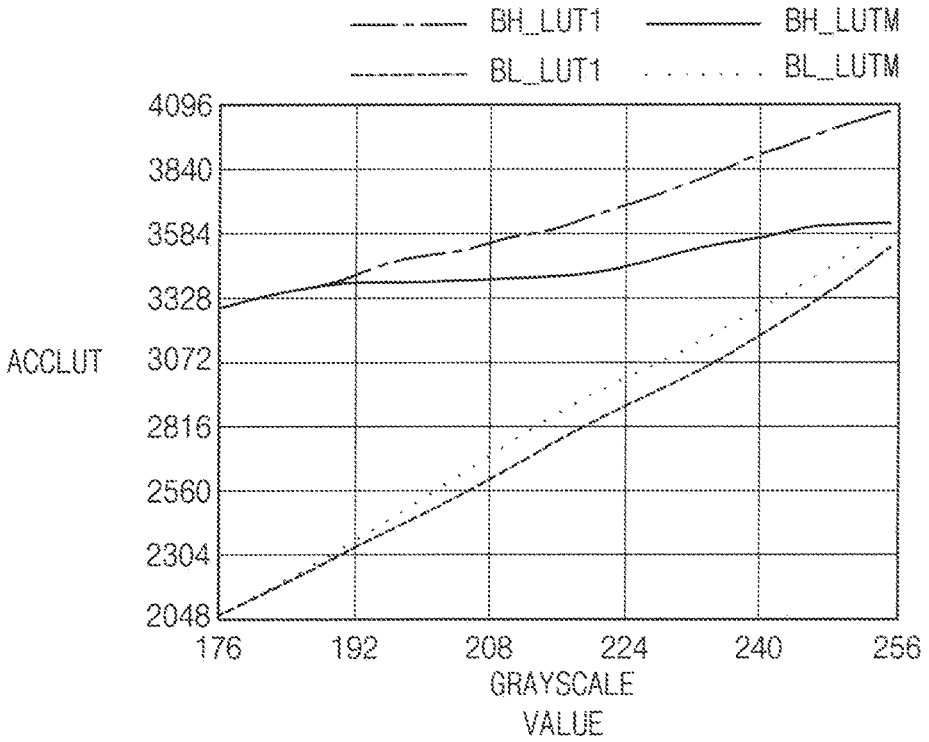
FIG. 9 is a graph illustrating a high grayscale range of FIG. 7.
Figure 10:
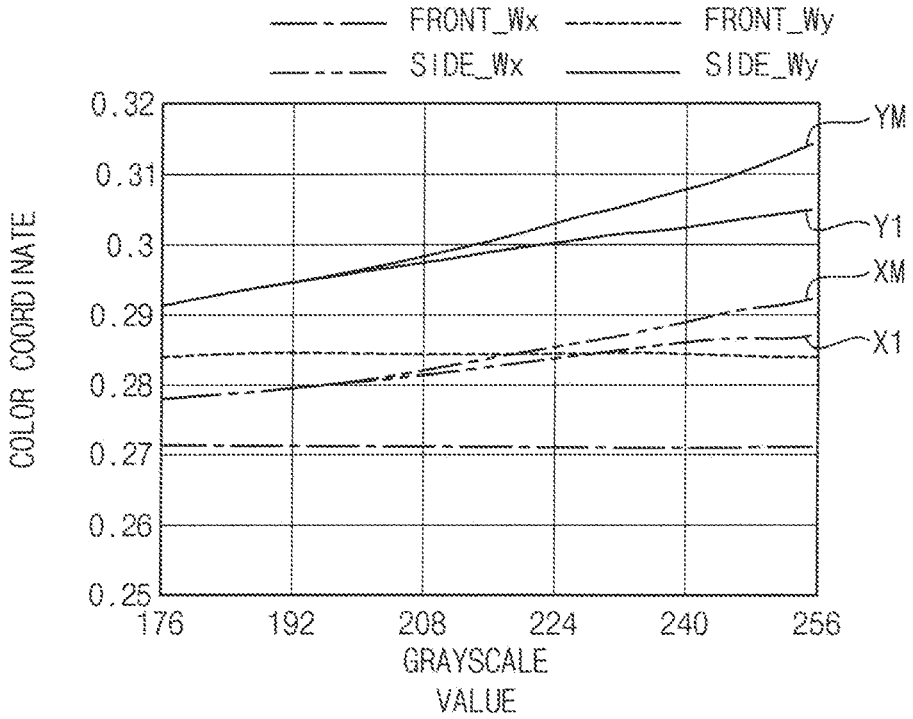
FIG. 10 is a graph illustrating a high grayscale range of FIG. 8.
Figure 11:
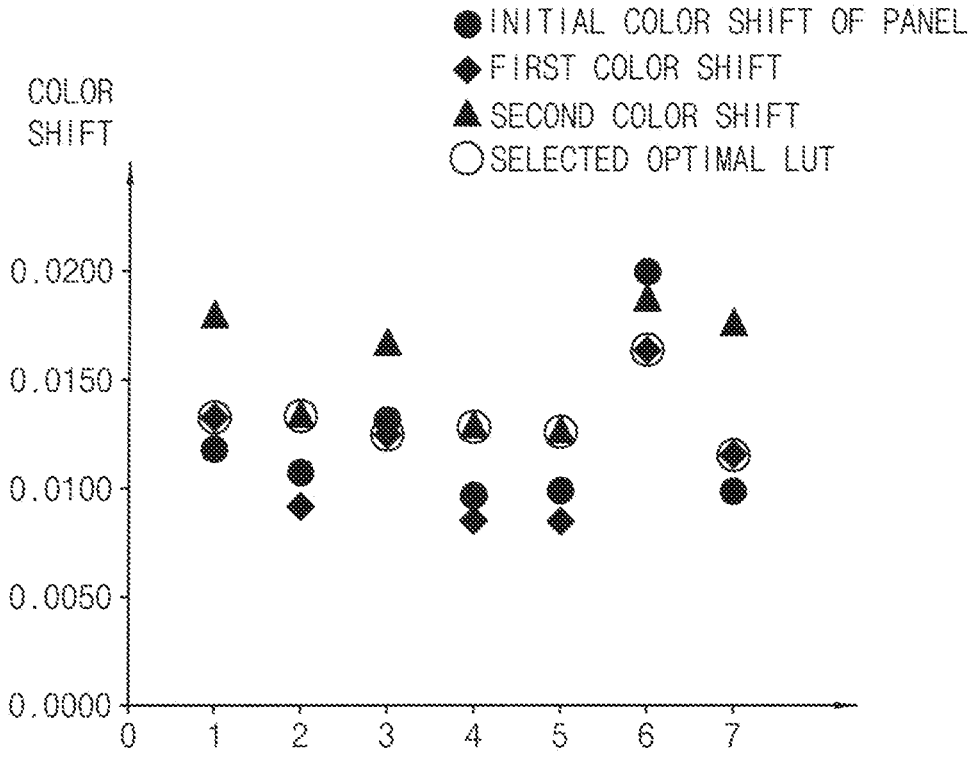
FIG. 11 is a graph illustrating a step of S600 of FIG. 4.

FIG. 7 is a graph illustrating a first compensation lookup table and a second compensation lookup table of the display apparatus of FIG. 1. FIG. 8 is a graph illustrating a front color coordinate and a side color coordinate of a first image to which the first compensation lookup table of FIG. 7 is applied and a front color coordinate and a side color coordinate of a second image to which the second compensation lookup table of FIG. 7. FIG. 9 is a graph illustrating a high grayscale range of FIG. 7. FIG. 10 is a graph illustrating a high grayscale range of FIG. 8. FIG. 11 is a graph illustrating a step of S600 of FIG. 4.

Referring to FIGS. 1 to 10, RGB XYZ for the grayscale having the compensated color sense may be predicted (step S400) using the result of the step S200 and the step S300.

In the step S400, "the grayscale having the compensated color sense" may mean the grayscale value of the input image data IMG2 having the compensated color coordinate which is converted from the grayscale value of the input image data IMG.

First color shifts of the display panels may be determined using the predicted tristimulus values of the entire grayscale values (step S200), the compensated color coordinate (step S300) and the first compensation lookup table LUT1.

The first compensation lookup table LUT1 may be ACC lookup table. The first compensation lookup table LUT1 may convert the grayscale value of the input image data IMG2 having the compensated color coordinate into ACC value to represent a target gamma value and the target color coordinate. For example, the ACC value may have the number of bits greater than the number of bits of the grayscale value of the input image data IMG2 having the compensated color coordinate. For example, the number of bits of the grayscale value of the input image data IMG2 having the compensated color coordinate may be 8 bits and the number of bits of the ACC value may be 12 bits. The ACC value is generated by converting the grayscale value of the input image data IMG2 having the compensated color coordinate to represent the target gamma value and the target color coordinate. The ACC value may substantially correspond to a luminance.

Second color shifts of the display panels may be determined using the predicted tristimulus values of the entire grayscale values (step S200), the compensated color coordinate (step S300) and the second compensation lookup table LUTM. (step S500)

The second compensation lookup table LUTM may be ACC lookup table. The second compensation lookup table LUTM may convert the grayscale value of the input image data IMG2 having the compensated color coordinate into ACC value to represent the target gamma value and the target color coordinate.

The second compensation lookup table LUTM may be a "modified ACC lookup table" from the first compensation lookup table LUT1. The second compensation lookup table LUTM may be different from the first compensation lookup table LUT1. The second compensation lookup table LUTM may be generated based on the first compensation lookup table LUT1 to decrease a difference between a luminance of the high subpixel and a luminance of the low subpixel.

The driving controller 200 of the display apparatus may include the first compensation lookup table LUT1 and the second compensation lookup table LUTM.

Although the first and second compensation lookup tables LUT1 and LUTM for the single color (e.g., blue) are illustrated in FIGS. 7 to 10 for convenience of explanation, the display apparatus may include the first and second compensation lookup tables LUT1 and LUTM for the first color, the second color and the third color. In this case, the number of the compensation lookup tables may be six.

The first compensation lookup table LUT1 may include a first high lookup table corresponding to a first high gamma curve BH_LUT1 and a first low lookup table corresponding to a first low gamma curve BL_LUT1. A high data voltage applied to the high subpixel of FIG. 3 may be generated using the high lookup table. A low data voltage applied to the low subpixel of FIG. 3 may be generated using the low lookup table.

The second compensation lookup table LUTM may include a second high lookup table corresponding to a second high gamma curve BH_LUTM and a second low lookup table corresponding to a second low gamma curve BL_LUTM.

The first high gamma curve BH_LUT1 may coincide with the second high gamma curve BH_LUTM in a grayscale range lower than a reference grayscale value. The first high gamma curve BH_LUT1 may be different from the second high gamma curve BH_LUTM in a grayscale range equal to or greater than the reference grayscale value. The first low gamma curve BL_LUT1 may coincide with the second low gamma curve BL_LUTM in the grayscale range lower than the reference grayscale value. The first low gamma curve BL_LUT1 may be different from the second low gamma curve BL_LUTM in the grayscale range equal to or greater than the reference grayscale value.

In an example embodiment, the reference grayscale value may be about 185 grayscale as shown in FIGS. 7 and 9. The first high gamma curve BH_LUT1 may coincide with the second high gamma curve BH_LUTM in a low grayscale range. The first high gamma curve BH_LUT1 may be different from the second high gamma curve BH_LUTM in a high grayscale range. The first low gamma curve BL_LUT1 may coincide with the second low gamma curve BL_LUTM in the low grayscale range. The first low gamma curve BL_LUT1 may be different from the second low gamma curve BL_LUTM in the high grayscale range.

A difference between the first high gamma curve BH_LUT1 and the first low gamma curve BL_LUT1 may be greater than a difference between the second high gamma curve BH_LUTM and the second low gamma curve BL_LUTM in the grayscale range equal to or greater than the reference grayscale value.

The second compensation lookup table LUTM may be set to have a difference between the high gamma curve BH_LUTM and the low gamma curve BL_LUTM less than that of the first compensation lookup table LUT1 in the high grayscale range.

When the difference between the high gamma curve BH_LUTM and the low gamma curve BL_LUTM decreases, the difference between the high data voltage of the high subpixel and the low data voltage of the low subpixel may decrease. When the difference between the high gamma curve BH_LUTM and the low gamma curve BL_LUTM decreases, the side visibility of the display panel may become worse.

In FIGS. 8 and 10, a front color coordinate FRONT_Wx and FRONT_Wy of a first image generated by applying the first compensation lookup table LUT1 to the input image data IMG or IMG2 may be controlled to coincide with a front color coordinate FRONT_Wx and FRONT_Wy of a second image generated by applying the second compensation lookup table LUTM to the input image data IMG or IMG2.

In contrast, a side color coordinate SIDE_Wx and SIDE_Wy of the first image may be different from a side color coordinate SIDE_Wx and SIDE_Wy of the second image. The side color coordinate X1 and Y1 of the first image may be less than the side color coordinate XM and YM of the second image.

Thus, the difference (the first color shift) between the front color coordinate and the side color coordinate of the first image may be less than the difference (the second color shift) between the front color coordinate and the side color coordinate of the second image.

The difference of the high data voltage and the low data voltage of the first image is greater than the difference of the high data voltage and the low data voltage of the second image so that the side visibility of the first image may be greater than the side visibility of the second image. The second image has a relatively lower side visibility but the color shift of the side visibility is changed from the first color shift to the second color shift.

Each of the display apparatuses may select one of the first compensation lookup table LUT1 and the second compensation lookup table LUTM using the first color shifts of the display panels and the second color shifts of the display panels (step S600).

Each of the driving controllers 200 of the display apparatuses may selectively apply one of the first compensation lookup table LUT1 and the second compensation lookup table LUTM.

The display apparatus (e.g., 1000A) may selectively apply one of the first compensation lookup table LUT1 (the first color shift) and the second compensation lookup table LUTM (the second color shift) such that the difference of the color shift of the display apparatus (e.g., 1000A) and the color shifts of other display apparatuses (e.g., 1000B, 1000C, 1000D, 1000E, 1000F, 1000G, 1000H and 1000I) is minimized.

FIG. 11 represents seven display apparatuses 1, 2, 3, 4, 5, 6 and 7 having different process spreads. "INITIAL COLOR SHIFT OF PANEL" in FIG. 11 represents a color shift LUT1(IMG) generated by applying the first compensation lookup table LUT1 to the input image data IMG. "FIRST COLOR SHIFT" in FIG. 11 represents a color shift LUT1 (IMG2) generated by applying the first compensation lookup table LUT1 to the compensated input image data IMG2. "SECOND COLOR SHIFT" in FIG. 11 represents a color shift LUTM(IMG2) generated by applying the second compensation lookup table LUTM which is the modified lookup table to the compensated input image data IMG2. LUTM (IMG2) has a color shift value higher than a color shift value of the LUT1(IMG2) since the color shift value is increased by the modified lookup table LUTM.

"SELECTED OPTIMAL LUT" in FIG. 11 may mean the lookup table selected among LUT1(IMG2) and LUTM (IMG2) such that the difference between the color shifts of the display apparatuses is minimized by the step S600.

For example, the first compensation lookup table LUT1 is selected in the display apparatuses 1, 3, 6 and 7 in FIG. 11 and the second compensation lookup table LUTM is selected in the display apparatuses 2, 4 and 5 in FIG. 11.

According to the present example embodiment, each display apparatus may select the optimal value between the first color shift generated using the first compensation lookup table LUT1 and the second color shift generated using the second compensation lookup table LUTM so that the difference of the color shifts of the plural display apparatuses may be compensated.

Thus, the display quality of the display system including the plural display apparatuses may be enhanced.

Figure 12:
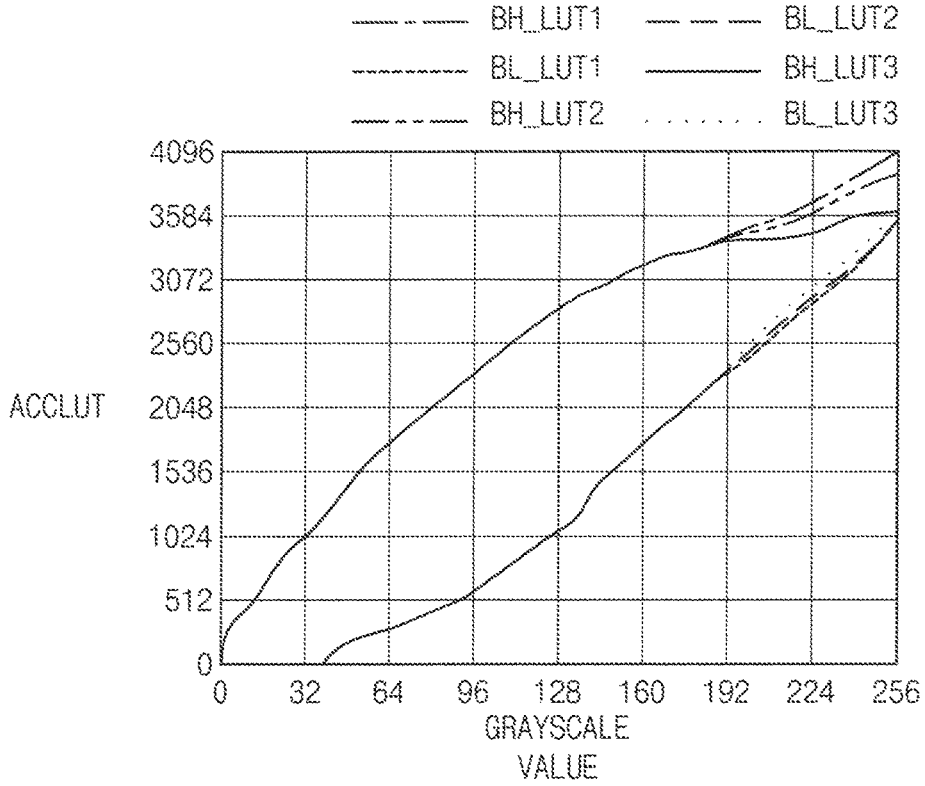
FIG. 12 is a graph illustrating a first compensation lookup table, a second compensation lookup table, and a third compensation lookup table of a display apparatus according to an example embodiment of the present inventive concept.
Figure 13:
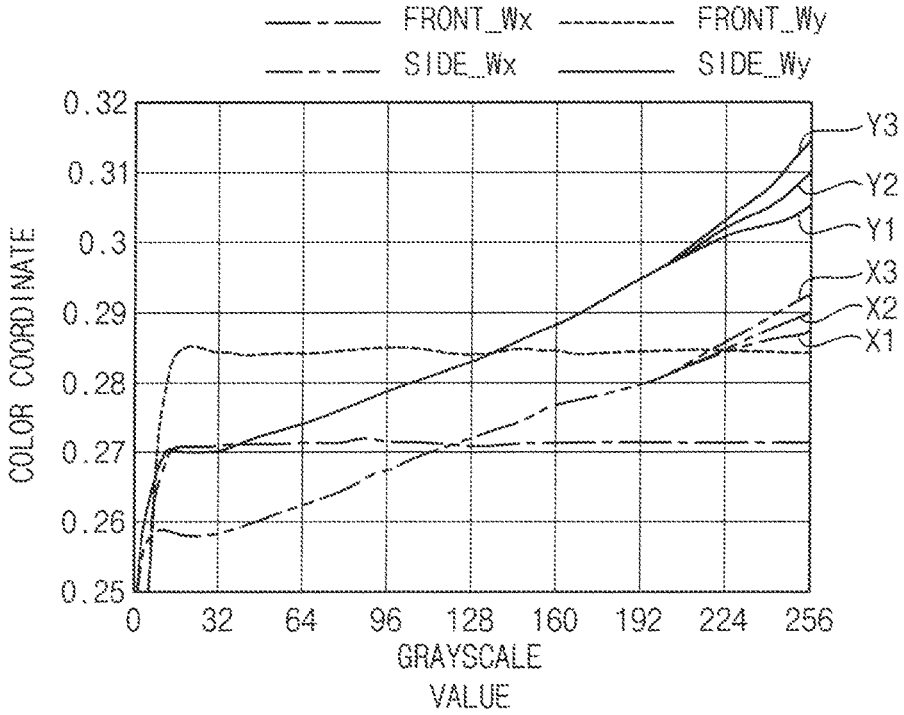
FIG. 13 is a graph illustrating a front color coordinate and a side color coordinate of a first image to which the first compensation lookup table of FIG. 12 is applied, a front color coordinate and a side color coordinate of a second image to which the second compensation lookup table of FIG. 12 and a front color coordinate and a side color coordinate of a third image to which the third compensation lookup table of FIG. 12.
Figure 14:
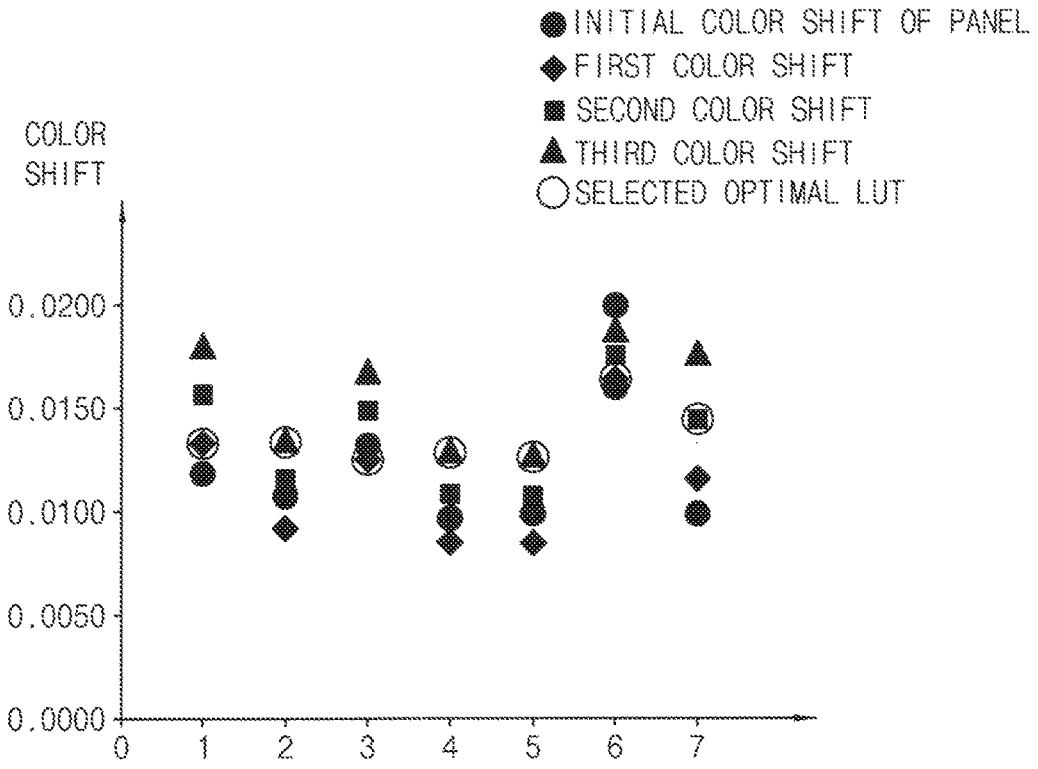
FIG. 14 is a graph illustrating an optimal lookup table of the display apparatus of FIG. 12.

FIG. 12 is a graph illustrating a first compensation lookup table, a second compensation lookup table, and a third compensation lookup table LUT3 of a display apparatus according to an example embodiment of the present inventive concept. FIG. 13 is a graph illustrating a front color coordinate and a side color coordinate of a first image to which the first compensation lookup table LUT1 of FIG. 12 is applied, a front color coordinate and a side color coordinate of a second image to which the second compensation lookup table LUT2 of FIG. 12 and a front color coordinate and a side color coordinate of a third image to which the third compensation lookup table LUT3 of FIG. 12. FIG. 14 is a graph illustrating an optimal lookup table of the display apparatus of FIG. 12.

The display apparatus, the display system and the method of compensating the display quality of the display apparatus according to the present example embodiment is substantially the same as the display apparatus, the display system and the method of compensating the display quality of the display apparatus of the previous example embodiment explained referring to FIGS. 1 to 11 except that the display apparatus further comprises a third compensation lookup table. Thus, the same reference numerals will be used to refer to the same or like parts as those described in the previous example embodiment of FIGS. 1 to 11 and any repetitive explanation concerning the above elements will be omitted.

Referring to FIGS. 1 to 6 and 12 to 14, the display system may include a plurality of display apparatuses 1000A, 1000B, 1000C, 1000D, 1000E, 1000F, 1000G, 1000H and 1000I. The display apparatuses may be disposed adjacent to each other. The display apparatuses may be disposed in a matrix form.

The display apparatus 1000A includes a display panel 100 and a display panel driver. The display panel driver includes a driving controller 200, a gate driver 300, a gamma reference voltage generator 400 and a data driver 500.

Front display images and side display images of the display apparatuses for the above-mentioned sample images (e.g., W16, W24, W32, . . . , W255, R255, G255 and B255) may be measured to compensate the spread of the color shift of the display apparatuses. (step S100)

The tristimulus values for entire grayscale values of the front display image and the side display image of the display panels may be predicted using the measured results for the above-mentioned sample images (e.g., W16, W24, W32, . . . , W255, R255, G255 and B255). (step S200)

The display apparatuses may compensate the color coordinates of the input image data IMG of the display panels (step S300).

RGB XYZ for the grayscale having the compensated color sense may be predicted using the result of the step S200 and the step S300 (step S400).

First color shifts of the display panels may be determined using the predicted tristimulus values of the entire grayscale values (step S200), the compensated color coordinate (step S300) and the first compensation lookup table.

Second color shifts of the display panels may be determined (step S500) using the predicted tristimulus values of the entire grayscale values (step S200), the compensated color coordinate (step S300) and the second compensation lookup table.

In the present example embodiment, third color shifts of the display panels may be determined using the predicted tristimulus values of the entire grayscale values (step S200), the compensated color coordinate (step S300) and the third compensation lookup table. (step S500)

Although the first, second and third compensation lookup tables for the single color (e.g., blue) are illustrated in FIG. 12 for convenience of explanation, the display apparatus may include the first, second and third compensation lookup tables for the first color, the second color and the third color. In this case, the number of the compensation lookup tables may be nine.

The first compensation lookup table LUT1 may include a first high lookup table corresponding to a first high gamma curve BH_LUT1 and a first low lookup table corresponding to a first low gamma curve BL_LUT1.

The second compensation lookup table LUT2 may include a second high lookup table corresponding to a second high gamma curve BH_LUT2 and a second low lookup table corresponding to a second low gamma curve BL_LUT2.

The third compensation lookup table LUT3 may include a third high lookup table corresponding to a third high gamma curve BH_LUT3 and a third low lookup table corresponding to a third low gamma curve BL_LUT3.

The first high gamma curve BH_LUT1, the second high gamma curve BH_LUT2 and the third high gamma curve BH_LUT3 may coincide with one another in a grayscale range lower than a reference grayscale value. The first low gamma curve BL_LUT1, the second low gamma curve BL_LUT2 and the third low gamma curve BL_LUT3 may coincide with one another in the grayscale range lower than the reference grayscale value.

The first high gamma curve BH_LUT1, the second high gamma curve BH_LUT2 and the third high gamma curve BH_LUT3 may be different from one another in a grayscale range equal to or greater than the reference grayscale value. The first low gamma curve BL_LUT1, the second low gamma curve BL_LUT2 and the third low gamma curve BL_LUT3 may be different from one another in the grayscale range equal to or greater than the reference grayscale value.

A difference between the first high gamma curve BH_LUT1 and the first low gamma curve BL_LUT1 may be greater than a difference between the second high gamma curve BH_LUT2 and the second low gamma curve BL_LUT2 in the grayscale range equal to or greater than the reference grayscale value. The difference between the second high gamma curve BH_LUT2 and the second low gamma curve BL_LUT2 may be greater than a difference between the third high gamma curve BH_LUT3 and the third low gamma curve BL_LUT3 in the grayscale range equal to or greater than the reference grayscale value.

The second compensation lookup table LUT2 may be set to have a difference between the high gamma curve BH_LUT2 and the low gamma curve BL_LUT2 less than that of the first compensation lookup table LUT1 in the high grayscale range. The third compensation lookup table LUT3 may be set to have a difference between the high gamma curve BH_LUT3 and the low gamma curve BL_LUT3 less than that of the second compensation lookup table LUT2 in the high grayscale range.

In FIG. 13, a front color coordinate FRONT_Wx and FRONT_Wy of a first image generated by applying the first compensation lookup table LUT1 to the input image data IMG or IMG2, a front color coordinate FRONT_Wx and FRONT_Wy of a second image generated by applying the second compensation lookup table LUT2 to the input image data IMG or IMG2 and a front color coordinate FRONT_Wx and FRONT_Wy of a third image generated by applying the third compensation lookup table LUT3 to the input image data IMG or IMG2 may be controlled to coincide with each other.

In contrast, a side color coordinate SIDE_Wx and SIDE_Wy of the first image may be different from a side color coordinate SIDE_Wx and SIDE_Wy of the second image. The side color coordinate X1 and Y1 of the first image may be less than the side color coordinate X2 and Y2 of the second image. In addition, the side color coordinate SIDE_Wx and SIDE_Wy of the second image may be different from a side color coordinate SIDE_Wx and SIDE_Wy of the third image. The side color coordinate X2 and Y2 of the second image may be less than the side color coordinate X3 and Y3 of the third image.

Thus, the difference (the first color shift) between the front color coordinate and the side color coordinate of the first image may be less than the difference (the second color shift) between the front color coordinate and the side color coordinate of the second image. In addition, the difference (the second color shift) between the front color coordinate and the side color coordinate of the second image may be less than the difference (the third color shift) between the front color coordinate and the side color coordinate of the third image.

Each of the display apparatuses may select one of the first compensation lookup table, the second compensation lookup table LUT2 and the third compensation lookup table LUT3 using the first color shifts of the display panels, the second color shifts of the display panels and the third color shifts of the display panels (step S600).

Each of the driving controllers 200 of the display apparatuses may selectively apply one of the first compensation lookup table, the second compensation lookup table LUT2 and the third compensation lookup table.

FIG. 14 represents seven display apparatuses 1, 2, 3, 4, 5, 6 and 7 having different process spreads. "INITIAL COLOR SHIFT OF PANEL" in FIG. 14 represents a color shift ACC1(IMG) generated by applying the first compensation lookup table LUT1 to the input image data IMG. "FIRST COLOR SHIFT" in FIG. 14 represents a color shift ACC1 (IMG2) generated by applying the first compensation lookup table LUT1 to the compensated input image data IMG2. "SECOND COLOR SHIFT" in FIG. 14 represents a color shift ACC2(IMG2) generated by applying the second compensation lookup table LUT2 which is the modified lookup table to the compensated input image data IMG2. "THIRD COLOR SHIFT" in FIG. 14 represents a color shift ACC3 (IMG2) generated by applying the third compensation lookup table LUT3 which is another modified lookup table to the compensated input image data IMG2. ACC2(IMG2) has a color shift value higher than a color shift value of the ACC1(IMG2) since the color shift value is increased by the modified lookup table LUT2. ACC3(IMG2) has a color shift value higher than a color shift value of the ACC2(IMG2) since the color shift value is increased by another modified lookup table LUT3.

"SELECTED OPTIMAL LUT" in FIG. 14 may mean the lookup table selected among ACC1(IMG2), ACC2(IMG2) and ACC3(IMG2) such that the difference between the color shifts of the display apparatuses is minimized by the step S600.

Although the difference of the color shifts is compensated using three different lookup tables for a single color in the present example embodiment, the present inventive concept may not be limited thereto. Alternatively, the difference of the color shifts may be compensated using four or more different lookup tables for a single color.

According to the present example embodiment, each display apparatus may select the optimal value between the first color shift generated using the first compensation lookup table, the second color shift generated using the second compensation lookup table LUT2 and the third color shift generated using the third compensation lookup table LUT3 so that the difference of the color shifts of the plural display apparatuses may be compensated.

Thus, the display quality of the display system including the plural display apparatuses may be enhanced.

Figure 15:
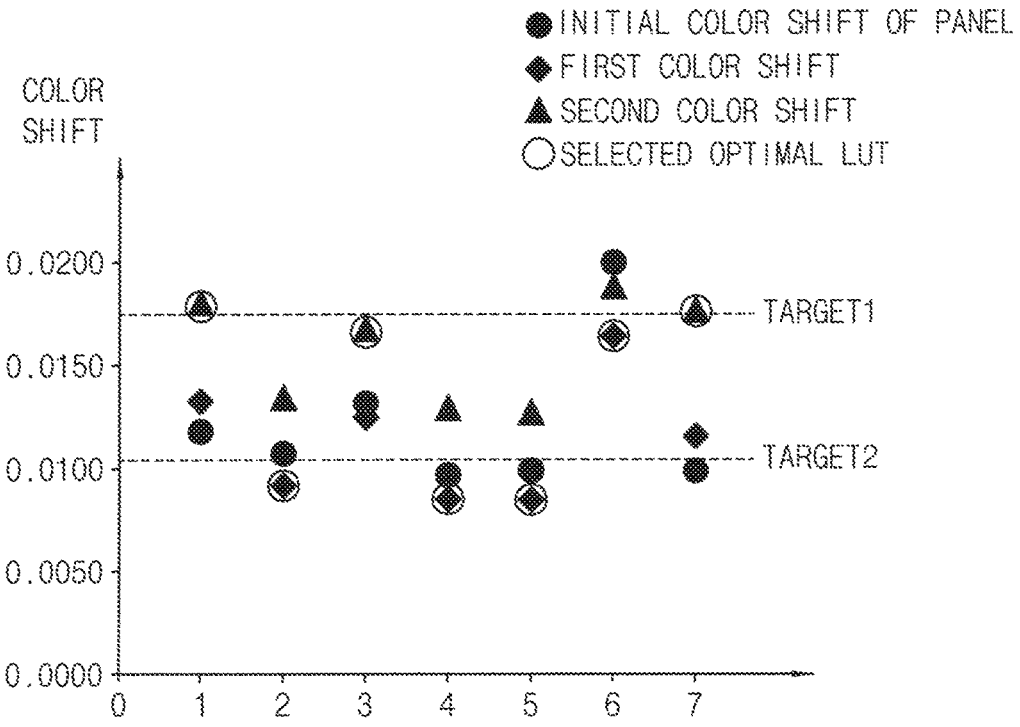
FIG. 15 is a graph illustrating an optimal lookup table of a display apparatus according to an example embodiment of the present inventive concept.

FIG. 15 is a graph illustrating an optimal lookup table of a display apparatus according to an example embodiment of the present inventive concept.

The display apparatus, the display system and the method of compensating the display quality of the display apparatus according to the present example embodiment is substantially the same as the display apparatus, the display system and the method of compensating the display quality of the display apparatus of the previous example embodiment explained referring to FIGS. 1 to 11 except for the method of selecting the optimal lookup table among the first compensation lookup table LUT1 and the second compensation lookup table. Thus, the same reference numerals will be used to refer to the same or like parts as those described in the previous example embodiment of FIGS. 1 to 11 and any repetitive explanation concerning the above elements will be omitted.

Referring to FIGS. 1 to 10 and 15, the display system may include a plurality of display apparatuses 1000A, 1000B, 1000C, 1000D, 1000E, 1000F, 1000G, 1000H and 1000I. The display apparatuses may be disposed adjacent to each other. The display apparatuses may be disposed in a matrix form.

The display apparatus 1000A includes a display panel 100 and a display panel driver. The display panel driver includes a driving controller 200, a gate driver 300, a gamma reference voltage generator 400 and a data driver 500.

Front display images and side display images of the display apparatuses for the above-mentioned sample images (e.g., W16, W24, W32, . . . , W255, R255, G255 and B255) may be measured to compensate the spread of the color shift of the display apparatuses. (step S100)

The tristimulus values for entire grayscale values of the front display image and the side display image of the display panels may be predicted based on the measured results for the above-mentioned sample images (e.g., W16, W24, W32, . . . , W255, R255, G255 and B255). (step S200)

The display apparatuses may compensate the color coordinates of the input image data IMG of the display panels (step S300).

RGB XYZ for the grayscale having the compensated color sense may be predicted using the result of the step S200 and the step S300. (step S400)

First color shifts of the display panels may be determined using the predicted tristimulus values of the entire grayscale values (step S200), the compensated color coordinate (step S300) and the first compensation lookup table.

Second color shifts of the display panels may be determined using the predicted tristimulus values of the entire grayscale values (step S200), the compensated color coordinate (step S300) and the second compensation lookup table. (step S500)

Each of the display apparatuses may select one of the first compensation lookup table LUT1 and the second compensation lookup table LUTM using the first color shifts of the display panels and the second color shifts of the display panels (step S600).

When each of the display apparatuses may select one of the first compensation lookup table LUT1 and the second compensation lookup table LUTM, a plurality of target color shifts may be used. For example, the display apparatuses 1, 3, 6 and 7 in FIG. 15 select the optimal lookup table with respect to a first target color shift TARGET1 and the display apparatuses 2, 4 and 5 in FIG. 15 select the optimal lookup table with respect to a second target color shift TARGET2.

Although seven display apparatuses are illustrated in FIG. 15 for convenience of explanation, the spread of the color shifts of thousands and tens of thousands of display apparatuses may be compensated in a manufacturing process of the display apparatuses in practice. When only a single target color shift is set in this situation, the spread of the color shifts of the display apparatuses may not be properly compensated. When the display apparatuses are divided into a plurality of groups and a plurality of target color shifts are respectively used for the groups, the spread of the color shifts of the display apparatuses in the group may be further reduced.

According to the present example embodiment, each display apparatus may select the optimal value between the first color shift generated using the first compensation lookup table LUT1 and the second color shift generated using the second compensation lookup table LUTM so that the difference of the color shifts of the plural display apparatuses may be compensated.

Thus, the display quality of the display system including the plural display apparatuses may be enhanced.

According to the example embodiments of the display apparatus, the method of compensating the display quality of the display apparatus using the display apparatus, the difference of the color shifts of the plural display apparatuses may be compensated so that the display quality of the display system including the plural display apparatuses may be enhanced.

The foregoing is illustrative of the present inventive concept and is not to be construed as limiting thereof. Although a few example embodiments of the present inventive concept have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific example embodiments disclosed, and that modifications to the disclosed example embodiments, as well as other example embodiments, are intended to be included within the scope of the appended claims. The present inventive concept is defined by the following claims, with equivalents of the claims to be included therein.

What is claimed is:

1. A display apparatus comprising:

a display panel configured to display an image based on input image data;

a gate driver configured to output gate signals to gate lines of the display panel;

a data driver configured to output data voltages to data lines of the display panel; and a driving controller including a first compensation lookup table and a second compensation lookup table which are configured to compensate the input image data, the driving controller configured to select one of the first compensation lookup table and the second compensation lookup table based on a first color shift and a second color shift and to apply the selected one of the first compensation lookup table and the second compensation lookup table to the input image data, wherein the first color shift means a difference between a front color coordinate and a side color coordinate of the input image data to which the first compensation lookup table is applied, and wherein the second color shift means a difference between a front color coordinate and a side color coordinate of the input image data to which the second compensation lookup table is applied.

2. The display apparatus of claim 1, wherein the first compensation lookup table comprises a first high lookup table corresponding to a first high gamma curve and a first low lookup table corresponding to a first low gamma curve, and wherein the second compensation lookup table comprises a second high lookup table corresponding to a second high gamma curve and a second low lookup table corresponding to a second low gamma curve.

3. The display apparatus of claim 2, wherein the first high gamma curve coincides with the second high gamma curve and the first low gamma curve coincides with the second low gamma curve in a grayscale range lower than a reference grayscale value, and wherein the first high gamma curve is different from the second high gamma curve and the first low gamma curve is different from the second low gamma curve in a grayscale range equal to or greater than the reference grayscale value.

4. The display apparatus of claim 3, wherein a difference between the first high gamma curve and the first low gamma curve is greater than a difference between the second high gamma curve and the second low gamma curve.

5. The display apparatus of claim 2, wherein a front color coordinate of a first image to which the first compensation lookup table is applied coincides with a front color coordinate of a second image to which the second compensation lookup table.

6. The display apparatus of claim 5, wherein a side color coordinate of the first image is different from a side color coordinate of the second image.

7. The display apparatus of claim 6, wherein a difference between the front color coordinate and the side color coordinate of the first image is less than a difference between the front color coordinate and the side color coordinate of the second image.

8. The display apparatus of claim 1, wherein the driving controller further comprises a third compensation lookup table, the driving controller configured to select one of the first compensation lookup table, the second compensation lookup table and the third compensation lookup table and to apply the selected one of the first compensation lookup table, the second compensation lookup table and the third compensation lookup table to the input image data, wherein the first compensation lookup table comprises a first high lookup table corresponding to a first high gamma curve and a first low lookup table corresponding to a first low gamma curve, wherein the second compensation lookup table comprises a second high lookup table corresponding to a second high gamma curve and a second low lookup table corresponding to a second low gamma curve, and wherein the third compensation lookup table comprises a third high lookup table corresponding to a third high gamma curve and a third low lookup table corresponding to a third low gamma curve.

9. The display apparatus of claim 8, wherein the first high gamma curve, the second high gamma curve and the third high gamma curve coincide with one another and the first low gamma curve, the second low gamma curve and the third low gamma curve coincide with one another in a grayscale range lower than a reference grayscale value, and wherein the first high gamma curve, the second high gamma curve and the third high gamma curve are different from one another and the first low gamma curve, the second low gamma curve and the third low gamma curve are different from one another in a grayscale range equal to or greater than the reference grayscale value.

10. The display apparatus of claim 1, wherein the display panel comprises a plurality of pixels, wherein the pixel comprises:

a first switching element connected to a first gate line and a first data line;

a first capacitor connected to the first switching element;

a second switching element connected to the first gate line and a second data line; and a second capacitor connected to the second switching element.

11. A display system comprising:

a first display apparatus comprising a first compensation lookup table and a second compensation lookup table and configured to select one of the first compensation lookup table and the second compensation lookup table based on a first color shift, which means a difference between a front color coordinate and a side color coordinate of the input image data to which the first compensation lookup table is applied, and a second color shift, which means a difference between a front color coordinate and a side color coordinate of the input image data to which the second compensation lookup table is applied, and to apply the selected one of the first compensation lookup table and the second compensation lookup table to the input image data; and a second display apparatus comprising the first compensation lookup table and the second compensation lookup table and configured to select one of the first compensation lookup table and the second compensation lookup table based on the first color shift and the second color shift and to apply the selected one of the first compensation lookup table and the second compensation lookup table to the input image data.

12. The display system of claim 11, wherein the first display apparatus is configured to select one of the first compensation lookup table and the second compensation lookup table such that a difference of a color shift of the first display apparatus and a color shift of the second display apparatus is minimized, and wherein the second display apparatus is configured to select one of the first compensation lookup table and the second compensation lookup table such that the difference of the color shift of the first display apparatus and the color shift of the second display apparatus is minimized.

13. A method of compensating a display quality of a display apparatus, the method comprising:

measuring a front display image and a side display image of each of display panels of display apparatuses;

predicting tristimulus values of the front display image and the side display image of the each of the display panels for entire grayscale values;

compensating color coordinates of input image data of the each of the display panels;

determining first color shifts of the each of the display panels using the predicted tristimulus values for the entire grayscale values, the compensated color coordinate and a first compensation lookup table of the each of the display panels;

determining second color shifts of the each of the display panels using the predicted tristimulus values for the entire grayscale values, the compensated color coordinate and a second compensation lookup table of the each of the display panels; and selecting one of the first compensation lookup table and the second compensation lookup table in the each of the display panels using the first color shifts of the each of the display panels and the second color shifts of the each of the display panels.

14. The method of claim 13, wherein the predicting the tristimulus values for the entire grayscale values comprises calculating a luminance of a first color, a luminance of a second color and a luminance of a third color in a first grayscale value using a formula below:

$$\begin{bmatrix} \frac{R_x}{R_y} & \frac{G_x}{G_y} & \frac{B_x}{B_y} \\ 1 & 1 & 1 \\ \frac{R_z}{R_y} & \frac{G_z}{G_y} & \frac{B_z}{B_y} \end{bmatrix}^{-1} \begin{bmatrix} X_{gray} \\ Y_{gray} \\ Z_{gray} \end{bmatrix} = \begin{bmatrix} Y_R \\ Y_G \\ Y_B \end{bmatrix}$$

where, in the first grayscale value, Rx is x color coordinate of the first color, Ry is y color coordinate of the first color and Rz=1−Rx−Ry, Gx is x color coordinate of the second color, Gy is y color coordinate of the second color, and Gz=1−Gx−Gy, Bx is x color coordinate of the third color and By is y color coordinate of the third color and Bz=1−Bx−By, the measured tristimulus values of an achromatic color in the first grayscale value are Xgray, Ygray and Zgray, and a luminance of the first color is YR, a luminance of the second color is YG and a luminance of the third color is YB.

15. The method of claim 13, wherein the compensating the color coordinates of the input image data comprises clipping a grayscale value outside a target color coordinate.

16. The method of claim 13, wherein the first compensation lookup table comprises a first high lookup table corresponding to a first high gamma curve and a first low lookup table corresponding to a first low gamma curve, and wherein the second compensation lookup table comprises a second high lookup table corresponding to a second high gamma curve and a second low lookup table corresponding to a second low gamma curve.

17. The method of claim 16, wherein the first high gamma curve coincides with the second high gamma curve and the first low gamma curve coincides with the second low gamma curve in a grayscale range lower than a reference grayscale value, and wherein the first high gamma curve is different from the second high gamma curve and the first low gamma curve is different from the second low gamma curve in a grayscale range equal to or greater than the reference grayscale value.

18. The method of claim 13, further comprising determining third color shifts of the each of the display panels using the predicted tristimulus values for the entire grayscale values, the compensated color coordinate and a third compensation lookup table of the each of the display panels, wherein the first compensation lookup table comprises a first high lookup table corresponding to a first high gamma curve and a first low lookup table corresponding to a first low gamma curve, wherein the second compensation lookup table comprises a second high lookup table corresponding to a second high gamma curve and a second low lookup table corresponding to a second low gamma curve, and wherein the third compensation lookup table comprises a third high lookup table corresponding to a third high gamma curve and a third low lookup table corresponding to a third low gamma curve.

19. The method of claim 13, wherein the each of the display panels is configured to select one of the first compensation lookup table and the second compensation lookup table such that a difference of a color shift between the display panels become minimized.

20. The method of claim 13, wherein the selecting one of the first compensation lookup table and the second compensation lookup table in the each of the display panels using the first color shifts of the each of the display panels and the second color shifts of the each of the display panels uses a plurality of target color shift.

* * * * *